United States Patent [19]

Fercke

[11] 4,166,153

[45] Aug. 28, 1979

[54] LOW-ALLOY ZINC MATERIAL AND COIN-PRODUCTS MADE THEREOF

[75] Inventor: Wilhelm Fercke, Altena, Fed. Rep. of Germany

[73] Assignee: Vereinigte Deutsche Metallwerke Aktiengesellschaft, Frankfurt am Main, Fed. Rep. of Germany

[21] Appl. No.: 891,237

[22] Filed: Mar. 29, 1978

[30] Foreign Application Priority Data

Apr. 2, 1977 [DE] Fed. Rep. of Germany ..... 2714887

[51] Int. Cl.[2] ..... C22C 17/00

[52] U.S. Cl. ..... 428/577; 63/20; 75/178 A; 75/178 D; 428/457

[58] Field of Search ..... 75/178 R, 178 A, 178 AM, 75/178 D; 428/577; 63/20

[56] References Cited

U.S. PATENT DOCUMENTS

| | | | |
|---|---|---|---|
| 1,888,202 | 11/1932 | Graham | 75/178 |
| 2,448,169 | 8/1948 | Boyle et al. | 75/178 |
| 2,589,398 | 3/1952 | Kornblum | 75/178 |
| 3,125,788 | 3/1964 | Pelzel | 22/212 |
| 3,527,601 | 9/1970 | Foerster | 75/178 |
| 3,720,510 | 3/1973 | Isobe et al. | 75/178 AM |
| 3,772,007 | 11/1973 | Pelzel et al. | 75/178 A |

FOREIGN PATENT DOCUMENTS

| | | | |
|---|---|---|---|
| 2142685 | 3/1973 | Fed. Rep. of Germany | 75/178 AM |

*Primary Examiner*—L. Dewayne Rutledge
*Assistant Examiner*—Upendra Roy
*Attorney, Agent, or Firm*—Sprung, Felfe, Horn, Lynch & Kramer

[57] ABSTRACT

A low-alloy zinc material is disclosed containing a minor amount of titanium, e.g., 0.05 to 1.0 weight percent titanium. The alloy material can be formed into objects which have good cold workability, strength and resistance to corrosion. The zinc alloy materials are tarnish-resistant and can readily be embossed, hollowed, pressed, bent, or the like. They are especially useful as coining material to form coins, coin blanks, plaques, medals, and other useful and/or decorative objects.

2 Claims, No Drawings

LOW-ALLOY ZINC MATERIAL AND COIN-PRODUCTS MADE THEREOF

BACKGROUND OF THE INVENTION

1. Field of the Invention

This invention relates to a low-alloy zinc material. More especially, this invention relates to a zinc alloy containing a minor amount of titanium. This invention is especially directed to a zinc alloy which has good wear and abrasion resistance, embossability, and strength and is suitable for manufacture into coins, coin blanks, and the like. This invention is directed to such a zinc alloy material which, furthermore, has good strength and good resistance to corrosion and tarnishing.

2. Discussion of the Prior Art

For the production of medals, plaques, decorative objects and the like, good cold forming qualities are required in addition to resistance to corrosion and tarnishing. In addition, the possibility must be provided for the performance of a variety of surface treatments.

Low-alloy zinc materials are known in a great variety (cf., for example, OE-PS 241,833, CH-PS 437,820). Attempts have been made to influence various properties of the basic material by the addition of alloying elements, and especially to increase the hardness and strength substantially above those of unalloyed zinc. These efforts have to some extent been quite successful, although the improvement of the one property has often been obtained at the cost of an impairment of the other. For example, a desirable great increase of the strength has often resulted in an appreciable lessening of resistance to corrosion.

For a long time, considerable efforts have been undertaken for the purpose of replacing the formerly common coin materials with other materials. Whereas in the case of the conventional coin materials, especially silver alloys, the value of the metal constituted a considerable part of the value of the coin, even exceeding it in some cases, the value of the metal in modern coins is of entirely secondary importance. Instead, increasing importance is being attached to the need for practical and uniform qualities in the coins that are to be made from the metal. For example, they must not corrode under a wide variety of conditions, they must retain their original color, and they must be resistant to wear and abrasion. Furthermore, since coin-operated machines are growing in popularity, increasing attention is being focused on the suitability of coins for use in such equipment. It must be assured that the coin material can be adapted to the advanced testing methods designed to preclude the cheating of coin-operated equipment. These and a number of other aspects are involved in the choice of a suitable material for making coins.

When a metal is to be used as a material for the production of medals, plaques and jewelry, the following considerations are important. For such articles, tin is often used as a material. This metal is comparatively expensive and is not the best choice in all cases as far as the desired characteristics are concerned. The problem thus exists of finding a material which will satisfy all of the above, sometimes conflicting, requirements, i.e., on which will have all of the above-mentioned qualtities simultaneously.

SUMMARY OF THE INVENTION

Broadly, this invention contemplates a zinc alloy comprising zinc and a minor amount of titanium. Preferably, the low-alloy zinc of the present invention contains 0.01 to 1 percent by weight titanium.

In accordance with this invention, there is provided a zinc alloy which is improved such that it possesses good corrosion and tarnish resistance, together with good wear and abrasion characteristics with easy formability. Objects made from the zinc alloy of the present invention can be readily surface treated, such as by being bent, cut, embossed, hollowed, or the like.

It has been further found in accordance with the invention that resistance to tarnishing can be improved if the alloy material contains 0.02 to 0.5 weight percent cadmium. The presence of cadmium is desirable, since cadmium is capable of forming a compound with any titanium which might remain in the alloy in an undissolved state.

Magnesium is desirably co-present with the titanium and optionally the cadmium, since it has been found that magnesium further improves the wear and abrasion resistance of such a zinc-based alloy. Preferably, magnesium is present in an amount of 0.002 to 0.1 weight percent magnesium.

The zinc alloy can be still further improved by the inclusion of 0.003 to 4 percent by weight of aluminum. The inclusion of aluminum in such a zinc-based alloy facilitates the casting of material and improves the fineness of the grain. Aluminum, like cadmium, can bind any titanium that may remain in the alloy in undissolved state.

Preferably, the alloy of the present invention comprises:

0.01 to 1.0 weight percent titanium,
0.02 to 0.5 weight percent cadmium,
0.002 to 0.10 weight percent magnesium,
0.003 to 4 weight percent aluminum, with the balance consisting essentially of zinc (with the usual impurities).

It is to be noted that when cadmium is present, it is preferred that the aluminum content be kept at the lower end of the range. Specifically, it is preferred that the aluminum content not exceed 0.005 weight percent in order to avoid any possible impairment of the corrosion resistance.

In particular, zinc materials of the following composition have proven effective:

0.05 to 0.15% of titanium
0.002 to 0.01% magnesium
0.02 to 0.1% of cadmium
0.003 to 0.007% of aluminum
Remainder, zinc.

and 0.4 to 1.0% of titanium
0.002 to 0.10% of magnesium
0.8 to 4.0% of aluminum
Remainder, zinc.

Finally, it is possible to replace 0.01 to 0.4% of titanium with the same amount of zirconium.

For the preparation of the material, a kneading treatment by hot and cold forming operations can be employed, it being desirable, if the magnesium or the aluminum and/or cadmium content is high, to employ hot forming operations down to the final dimensions for the production of strips or sheets.

It has been found that low-alloy zinc materials, in addition to their suitability for coins and the like, can also be used for purposes for which tin is often used. The zinc materials are corrosion and tarnish resistant and can be surface-treated by burning, staining etc., and by brushing, blasting etc., and the desired effects obtained by these treatments (antique tin effect, for example) are long-lasting. The cold forming operation can be embossing, hollowing, pressing, bending etc.

The zinc-based alloys of the present invention can therefore be formed by intimately mixing the components thereof. For this purpose, preferably the components are mixed under heat to ensure intimate mixing of the various elements. The resultant alloy can be cast, extruded, molded, or the like into a final object which can have any of a wide variety of shapes, such as tubes, rods, sheets, ingots, etc. These in turn can be formed into further shapes which can be solid, hollow, or have virtually any configuration. Normally, the alloy is formed into a sheet and the sheet is worked down to a final thickness which may be only ten percent of the original thickness of the sheet. The sheet in turn can be processed, such as by hot or cold stamping out of desired shapes therefrom, or the sheet can be bent or otherwise formed into a desired article. Thus, the zinc alloy of the present invention is suitable to form zinc objects of any conceivable shape or size.

In order to more fully illustrate the nature of the invention and the manner of practicing the same, the following examples are presented:

EXAMPLES

EXAMPLE 1

First, fine zinc is melted at a temperature of 450° to 480° C. and then either a 5 percent titanium-zinc key alloy or a 5 percent zirconium-zinc key alloy is added in the spcified percentage, before magnesium metal is finally added.

Preferably the alloy is then cast in ingot molds to form ingots weighing from 800 to 1500 kg, because then the ingots can be hot rolled at uniform heat. The deformation in the hot rolling operation takes place at 200° to 230° C., with a reduction of 15 to 20% in each pass, for a total thickness reduction of approximately 80% to a thickness of 3.0 to 4.0 millimeters. Then follows a cold rolling operation with a thickness reduction of 5 to 10% per pass; the total thickness reduction must amount to at least 50%.

EXAMPLE 2

The 5% titanium-zinc key alloy or the 5% zirconium-zinc key alloy, as the case may be, is added to the fine zinc melt in the specified percentage at a temperature of 470° to 500° C., and then aluminum and/or cadmium metal plus, in the case of coin metal, preferably also magnesium key alloy is added.

At uniform heat the ingot is rolled to the finished strip or sheet at a temperature of 220° to 250° C., at a thickness reduction of 10 to 15% per pass and a total thickness reduction of approximately 90%.

The production of coins is performed by stamping roundels of the desired dimensions from strips hot-rolled or cold-rolled to appropriate thicknesses and having an HV 30 hardness of 75 to 90, this operation being performed by means of dies in coining presses. If desired, the roundels can then be provided with a rim from which the protective edge of the coin is formed in the coining operation. On account of the easy embossability of these zinc alloys, milling can largely be dispensed with, since the protective edge can be produced in the embossing operation without first producing a gather of material at the edge by knurling. In contrast to all other coin materials, the wear on the coining tools which is produced by unmilled roundels of the material to be used in accordance with the invention is not greater.

Then follows a washing and polishing operation for the cleaning and polishing of the blanks.

The blanks are then coined in coining presses.

The cold forming operation involved in the coining of these zinc alloys produces virtually no increase in hardness, so that the wear on the coining dies is much less than in the case of any other coin material.

What is claimed is:

1. An object in the form of a coin, coin blank, medal, plaque or sheet having good wear and abrasion resistance, embossability, strength and good resistance to corrosion and tarnishing wherein said object is formed of a low-alloy zinc material consisting essentially of 0.01 to 1.08 weight percent titanium
0.02 to 0.5 weight percent cadmium
0.002 to 0.108 weight percent magnesium
0.003 to 0.005 weight percent aluminum, the balance being zinc.

2. An object in the form of a coin, coin blank, medal, plaque or sheet having good wear in abrasion resistance, embossability, strength and good resistance to corrosion and tarnishing wherein said object is formed of a low-alloy zinc material consisting essentially of 0.4 to 1.0 weight percent titanium
0.002 to 0.10 weight percent magnesium
0.8 to 4 weight percent aluminum, the balance being zinc.

* * * * *